US009597851B2

(12) United States Patent
Kinney

(10) Patent No.: US 9,597,851 B2
(45) Date of Patent: Mar. 21, 2017

(54) PUSH FOLDING OF CARTON BLANKS

(71) Applicant: James Kinney, Hanover, IN (US)

(72) Inventor: James Kinney, Hanover, IN (US)

(73) Assignee: Southern Champion Tray, L.P., Chattanooga, TN (US)

( * ) Notice: Subject to any disclaimer, the term of this patent is extended or adjusted under 35 U.S.C. 154(b) by 0 days.

(21) Appl. No.: 14/466,796

(22) Filed: Aug. 22, 2014

(65) Prior Publication Data

US 2016/0052222 A1 Feb. 25, 2016

(51) Int. Cl.

| | |
|---|---|
| ***B65B 43/08*** | (2006.01) |
| ***B31B 3/26*** | (2006.01) |
| ***B65D 5/20*** | (2006.01) |
| ***B65D 5/24*** | (2006.01) |

(52) U.S. Cl.

CPC ..... *B31B 3/26* (2013.01); *B65B 43/08* (2013.01); *B65D 5/2057* (2013.01); *B65D 5/24* (2013.01)

(58) Field of Classification Search

CPC ..... B65D 5/2052; B31B 3/26; B31B 3/00; B65B 43/08; B65B 1/02; B65B 5/024; B65B 43/10

USPC ..... 53/456

See application file for complete search history.

(56) References Cited

U.S. PATENT DOCUMENTS

| | | | | | |
|---|---|---|---|---|---|
| 3,851,439 | A * | 12/1974 | Pillon | B31B 3/00 | 53/207 |
| 4,090,903 | A * | 5/1978 | Matsui | B29C 53/066 | 156/211 |
| 4,256,025 | A * | 3/1981 | Goda | B31B 1/44 | 493/160 |
| 4,693,051 | A * | 9/1987 | Mattei | B65B 5/024 | 53/148 |
| 5,531,373 | A * | 7/1996 | Eisman | B65D 5/6667 | 229/108 |
| 5,538,179 | A * | 7/1996 | Cai | B65D 5/6676 | 206/457 |
| 5,791,124 | A * | 8/1998 | Spatafora | B65B 5/026 | 53/444 |
| 5,794,405 | A * | 8/1998 | Weder | B65B 25/026 | 493/154 |
| 5,971,906 | A * | 10/1999 | Tharpe, Jr. | B31B 1/36 | 493/124 |
| 6,186,931 | B1 * | 2/2001 | Calvert | B31B 1/50 | 493/136 |
| 7,261,231 | B2 * | 8/2007 | Kuhn | B65D 5/008 | 229/114 |
| 7,470,225 | B2 * | 12/2008 | Herrin | B31B 1/00 | 493/126 |
| 7,470,226 | B1 * | 12/2008 | Herrin | B65D 5/0045 | 493/125 |

* cited by examiner

*Primary Examiner* — Sameh Tawfik
(74) *Attorney, Agent, or Firm* — Miller & Martin PLLC; Douglas T. Johnson

(57) ABSTRACT

A folding aid with registers is aligned with notches in a specially designed carton blank to facilitate the efficient manual construction of cartons with gusseted corners.

7 Claims, 11 Drawing Sheets

PUSH FOLDING OF CARTON BLANKS

FIELD OF THE INVENTION

This invention relates to an apparatus, carton blank and method for manually manipulating such a carton blank using the apparatus to form a gusseted, rectangular box that may be filled with products, locked, closed, and stacked.

BACKGROUND OF THE INVENTION

The food service industry consumes both an enormous quantity and great diversity of packaging, and particularly cartons or boxes, for food products. In commercial food production, cartons are formed at the packaging manufacturer on specialized automated equipment; are delivered to food processing facilities; and are filled and closed, usually in a highly automated fashion with additional specialized and automated closing equipment. However, in retail food service establishments such as fast food restaurants and specialty food shops such as confectioners, bakeries, groceries, and caterers, it is rarely practical from either an economic or logistical standpoint to employ specialized automated equipment to fill and close food cartons. Instead at such retail food service establishments, the food packaging process is manually performed. Several of the most common types of packaging are described below:

Formed, Prefolded and Glued Cartons:

Many styles of cartons may be formed then glued at the packaging converter on specialized equipment. Also, some types of cartons may be molded (shaped) from suitable materials, even though many suitable molding materials are foams or plastics that may not be environmentally friendly. To minimize space requirements at the user's location, the cartons may be designed to nest within one another when stacked. When a need arises for one of these preformed cartons, one is selected, filled with one or more food items, and manually closed, typically with some type of latching apparatus constructed in the lid or in one or more of the side walls. Even though preformed cartons may be nested and packed to reduce space requirements, such cartons are both more voluminous than the flat carton style blank packs (or bundles) and the nested styles require shipping in corrugated boxes. Conversely flat carton style blanks can be shipped with only plastic wrap packaging, and have only minimal amounts of empty space within the wrapped package.

Folded Carton Blanks/Glued and Unglued:

Alternatively, folded carton blank styles of paperboard (or other similar fibrous materials) may be obtained from a packaging converter and processed by automated folding and sealing apparatuses at the food processing facility to create cartons ready for loading and locking. Many cartons of this same style are also employed in the retail food service industry, and such cartons are preferably supplied in configurations so that the retail establishment does not require excessive space to store these types of cartons. This box style is particularly common with boxes (that due to size or structural and performance needs), cannot be easily nested (vertically stacked inside one another). However, the manual preparation of cartons at retail food service outlets diverts valuable employee time from the preparation and service of food. Some of these box styles can be prefolded and stored in a collapsed state and then opened and erected into their useful carton shape, usually with some further interlocking to maintain the shape, and thereby minimize the time required to create a useful carton from a flat blank (see FIGS. 1*a* & 1*b*). However, most designs for collapsible cartons have foldable and multi-part bottom panels that are not suitable to hold many food products. Such multi-part bottom cartons are characteristic of "perimeter type" blanks.

Conventionally, such a perimeter type box or carton is manufactured from a sheet of relevant material in a number of stages. First, the sheet is cut and creased to form the carton blank. The cuts and creases mark out the relevant portions of the carton panels that will form the carton's front, rear and side walls, its top and bottom surfaces, and any necessary flaps, tongues and slots, and so provide the blank with the shape that will define the resulting carton. The cuts and creases are also located to enable the basically flat sheet to be folded in the way required to construct the desired three dimensional carton. The perimeter construction usually requires one flap-part of the blank to be permanently affixed, by glue or staples for instance, to another part (usually one of the areas of the blank defining a wall panel of the carton). The next stage is to effect this affixation and the blank is conveniently designed so that this can be done with only a single fold of the blank and in such a way that a flat, easily stored, collapsed version of the carton results. Finally, for use, the folded and affixed blank is opened up and then further folded along the provided creases so as to move the wall and top and bottom portions into their required carton-defining positions. A typical example of a perimeter type blank for an exemplary box is shown as FIG. 1*a*, while FIG. 1*b* shows the box erected from that blank. It can be seen that the perimeter type construction leads to openings in the bottom of the carton between the multiple panels that form the bottom surface, and this structure does not lend itself to creation of an economical leak-resistant carton.

Flat Carton Blanks/Unglued:

Pizza boxes are a common example of this box style used in a retail food service packaging application. In contrast to the perimeter type blank, a typical pizza box is of a "base type" construction with a central panel to form the bottom of the carton and having wall and top panel extensions disposed around the base. However, this design is both time consuming to assemble and lacks leak resistant corners. A blank suitable to construct a base type pizza box is depicted in FIG. 2*a* and the carton constructed from that blank is shown in FIG. 2*b*. However, the base type blanks can be unnecessarily complicated. It is difficult to provide a leak resistant carton of base type construction that can be quickly assembled on an as needed basis.

Accordingly, there is a need for improved carton designs and methods of assembly suitable for use in retail food service settings. The present invention provides, in various embodiments, one or more of a carton blank, a carton folding aid, and a method of carton forming adapted to allow retail food service business to create leak resistant cartons from blanks in an efficient and economical fashion.

BRIEF DESCRIPTION OF THE INVENTION

Features of the present invention will become more readily apparent from the following description taken in conjunction with the accompanying drawings in which:

FIG. 1*a* is a prior art perimeter type carton blank.

FIG. 1*b* is a carton assembled from the prior art blank of FIG. 1*a*.

FIG. 2*a* is a prior art base type carton blank.

FIG. 2*b* is a carton assembled from the prior art blank of FIG. 2*a*.

FIG. 3 is an exemplary blank suitable for use in certain aspects of the invention.

FIG. 4*a* is a perspective view of an exemplary folding aid for use in practicing aspects of the carton forming steps of the invention.

FIG. 4*b* is a top plan view of the folding aid of FIG. 4*a*.

FIG. 4*c* is a sectional view of a folding guide of the folding aid of FIG. 4*a*.

FIG. 5*a* is a perspective view of the exemplary blank of FIG. 3*a* positioned on the folding aid of FIG. 4*a*.

FIG. 5*b* is a first sequential illustration of the carton blank and folding aid of FIG. 5*a* as the blank is pushed into the folded aid and the carton panels begin to be folded.

FIG. 5*c* is a second sequential illustration of the carton blank and folding aid of FIG. 5*a* with the carton panels substantially folded.

FIG. 5*d* is a perspective view of a carton formed by the carton blank of FIG. 3 after folding as illustrated in FIGS. 5*a*-5*c*.

DETAILED DESCRIPTION OF THE INVENTION

Figure 1A:
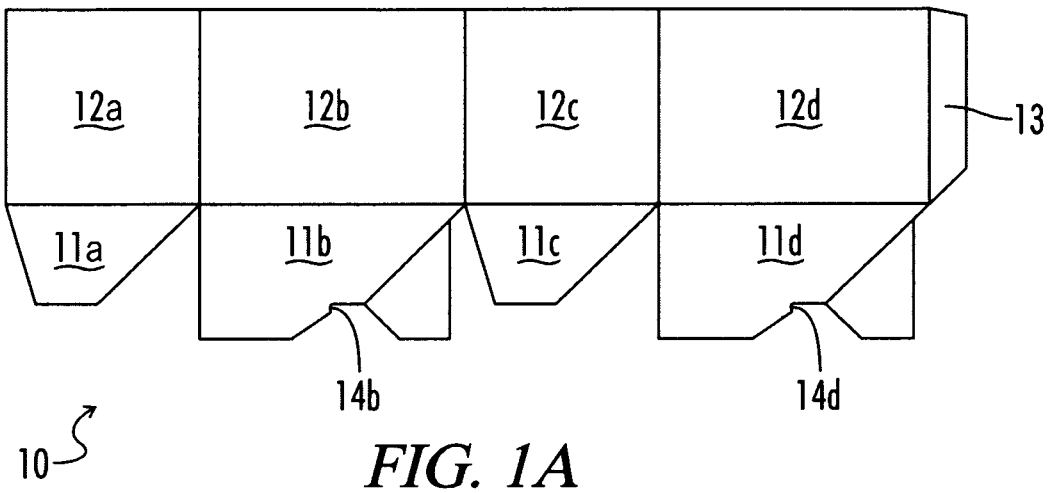
FIG. 1A (PRIOR ART)
Figure 1B:
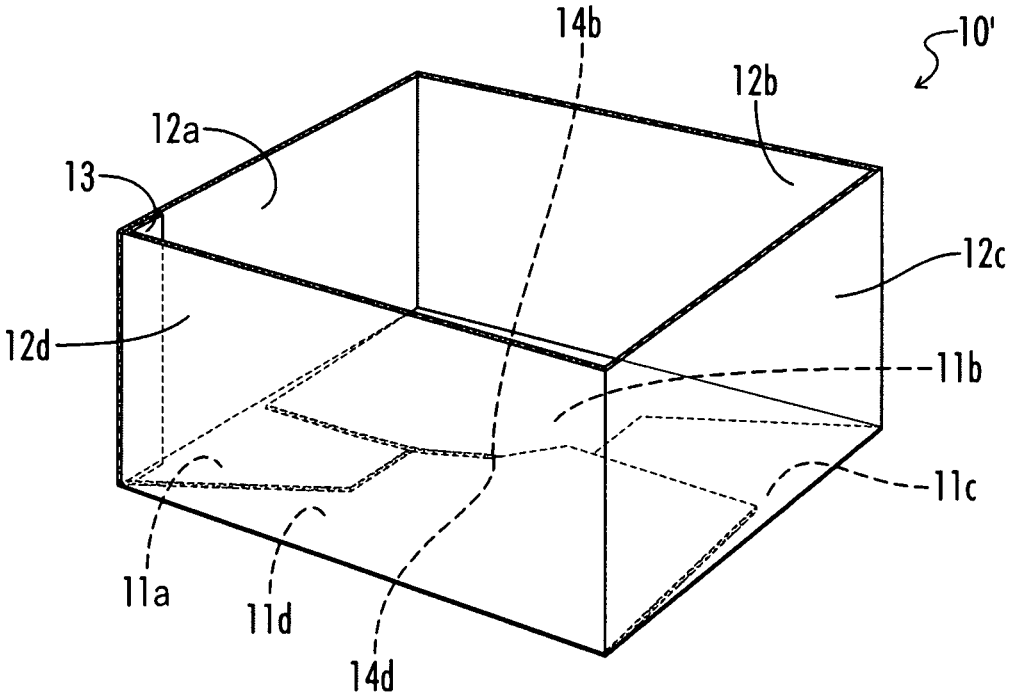
FIG. 1B (PRIOR ART)

The prior art carton blank 10 of FIG. 1*a* is of interest for the flaps 11*a*-11*d* that form the base of the erected carton shown in FIG. 1*b*. Prior to folding into a collapsed state, the perimeter of the carton is attached by the use of adhesive on tab 13 to connect to wall 12*a*. In the blank's collapsed state, not shown separately, the base forming flaps 11*a*-11*d* are folded up between the walls 12*a*-12*d* of the carton, and as the erection process takes place, the flaps 11*a*-11*d* drop down into place through what becomes the volume enclosed by the carton 10'. Thus, the carton 10' of FIG. 1*b* is erected from the blank 10 which, in its collapsed state, has its base flaps 11*a*-11*d* folded upwards to lie against its inner wall surfaces 12*a*-12*d*, and then upon erection, these flaps 11*a*-11*d* are encouraged to drop down into place, passing through the volume that is the inside of the carton 10'. The notches 14*b*, 14*d* on flaps 11*b*, 11*d* respectively, interlock so that the carton formed has some stability. Due to the multi-part base formed of flaps 11*a*, 11*b*, 11*c*, and 11*d*, it is not appropriate to put food items in the carton 10' that might exude liquid, since the liquid could leak out between the base flaps 11*a*-11*d*.

Figure 2A:
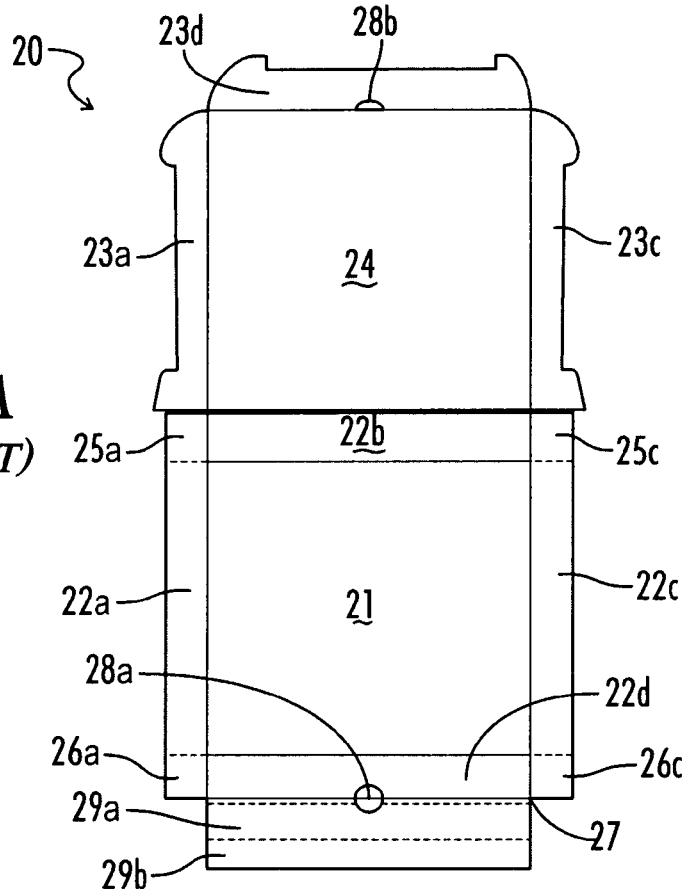
FIG. 2A (PRIOR ART)
Figure 2B:
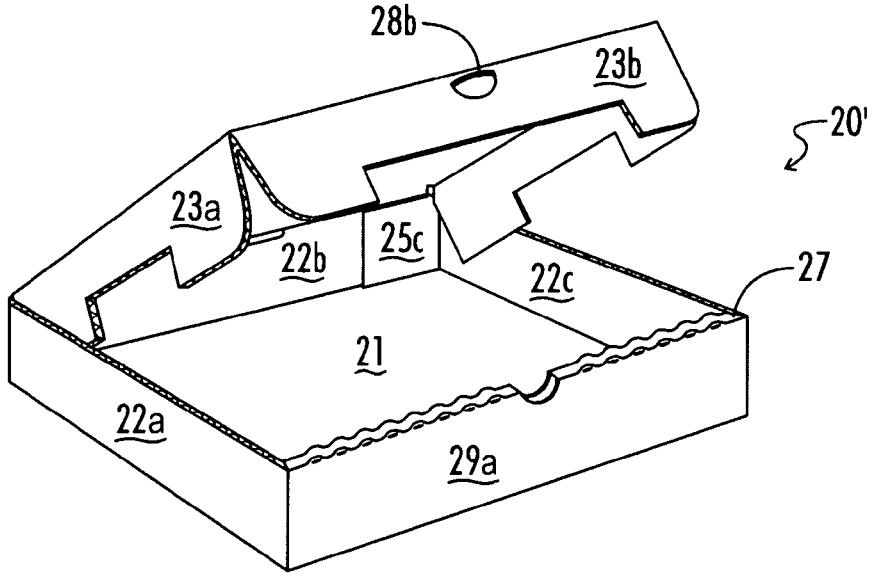
FIG. 2B (PRIOR ART)

Turning then to the prior art base-type carton blank 20 of FIG. 2*a*, the base 21 of the carton is a unitary panel surrounded by wall panels 22*a*-22*d*. At the ends of side wall panels 22*a*, 22*c* are rear folding tabs 25*a*, 25*c* and front folding tabs 26*a*, 26*c*. Connected along the top edge of rear wall panel 22*b* is top panel 24 and its side panels 23*a*, 23*c*, 23*d*. When constructed, the folding panels 29*a*, 29*b* of front wall 22*d* are folded inward so that panel 29*a* is adjacent and interior to front wall 22*d*, while panel 29*b* is frictionally engaged along the forward portion of the base 21. Tabs 26*a*, 26*c* folded inward and are inserted into the channel formed between front wall 22*d* and panel 29*a* while rear tabs 25*a*, 26*c* are folded inward of the rear wall 22*b*. The top 24 with its side panels can be folded downward so the side panels 23*a*, 23*c*, 23*d* are aligned inward of the side walls 22*a*, 22*c*, 22*d*. While the base type blank 20 forms a carton 20' with a solid base 21, the corner portions with front and rear tabs 25*a*, 25*c*, 26*a*, 26*c* are not in the form of gussets and fluid leakage may occur through those corner portions.

Figure 3:
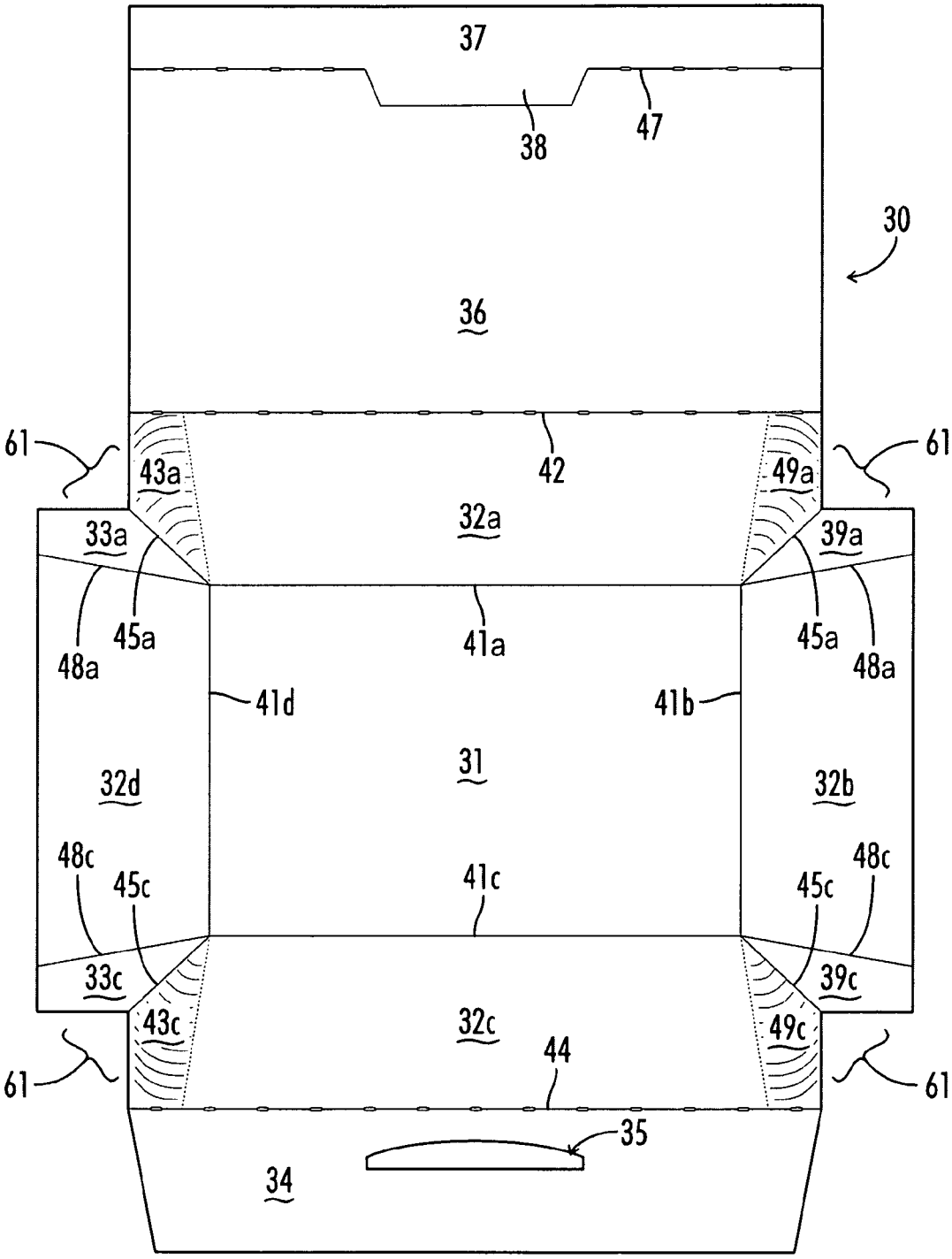

A different base type blank 30 that may be utilized in some aspects of the invention is illustrated in FIG. 3 and when utilized with folding aid 50 (shown in FIGS. 4*a*-4*c*) provides for the rapid construction of a carton 30' (shown in FIG. 5*d*) with a solid base 31 and outfold gussets at the corners that provide structural strength and resist leakage. The principal elements of blank 30 in FIG. 3 include the previously mentioned base 31, surrounded by fold lines 41*a*-41*d* that separate base 31 from the wall panels 32*a*-32*d*. The top of rear wall panel 32*a* has fold line 42 by which it is attached to top panel 36 which has a folding top flex lip 37 and latching tab 38 that flex or pivot along the fold line 47. Front wall panel 32*c* has a front lip flap 34 with latching opening 35, the flap 34 folding along line 44 where it connects to front wall 32*a*. Of particular interest are the outfold gusset forming elements and alignment notches 61 at the corners of the wall panels 32*a*-32*d*. Specifically, with regard to left wall panel 32*d*, there are inward fold score lines 48*a*, 48*c* and outward fold score lines 45*a*, 45*c*. These fold score lines allow side panel front edge 33*c* and rear edge 33*a* to be folded and faced against front panel landing area 43*c* and rear panel landing area 43*a* to form outfold gusset corners. The outward fold score lines 45*a*, 45*c* are oriented at about a 135° angle with respect to both the adjacent side wall fold line 41*d*, 41*b* and the rear wall fold line 41*a*. At the edges of the left wall side panel 32*d*, the inward fold score lines 48*a*, 48*c* are oriented at about a 100-105° angle with respect to the side wall fold line 41*d* and about a 165-170° angle with respect to the adjacent rear wall fold line 41*a* and front wall panel fold line 41*c*.

A similar outfold gusset structure is accomplished on the opposite side with right wall panel 32*b* and inward fold score lines 48*a*, 48*c* and outward fold score lines 45*a*, 45*c* allowing rear edge 39*a* and forward edge 39*c* of right wall panel 32*b* to be folded and faced against front and rear panel landing areas 49*c*, 49*a* respectively. Where the side panel front edges 33*c*, 39*c* and rear edges 33*a*, 39*a* are wider than rear wall panel 32*a* and front wall panel 32*c* alignment notches 61 are created. The formation of the outfold corner gussets is further elaborated as the use of carton blank 30 in connection with the folding aid 50 is discussed in connection with FIGS. 5*a*-5*d*.

Figure 4A:
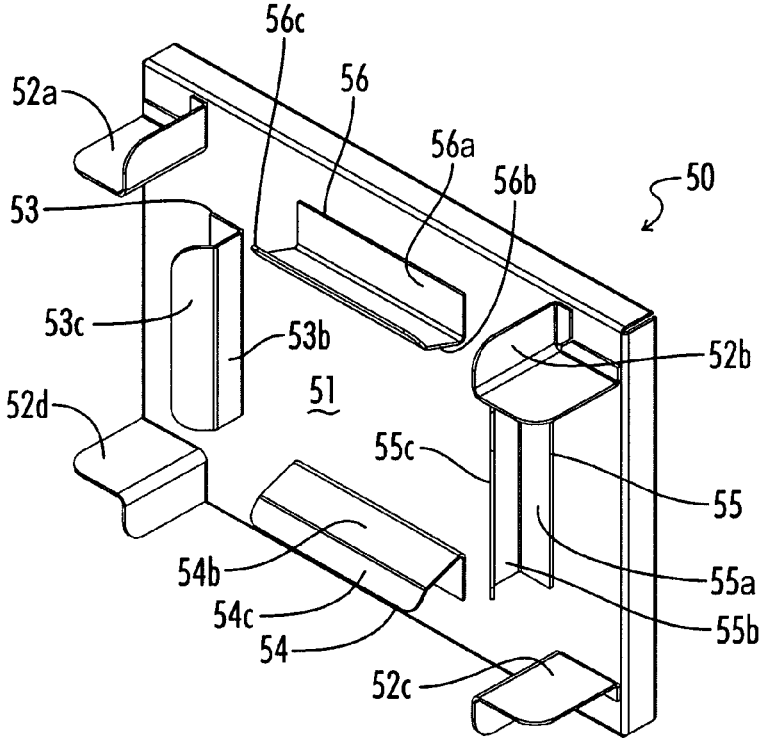
Figure 4B:
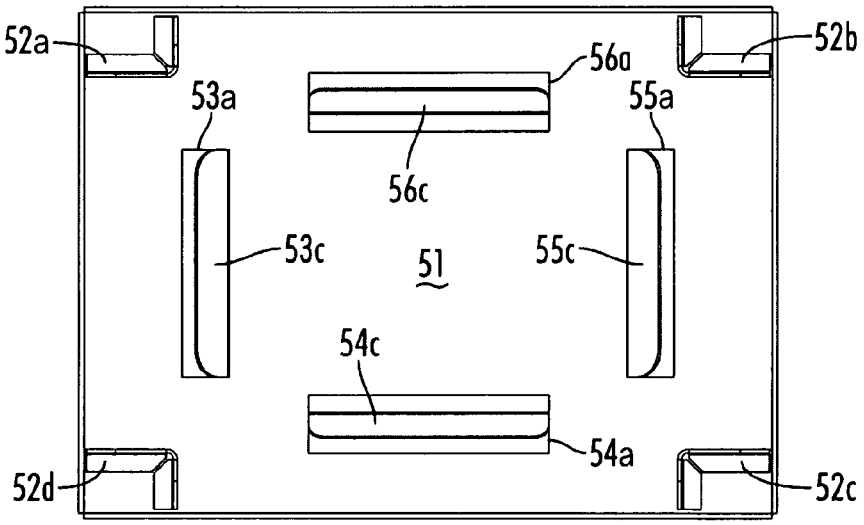
Figure 4C:
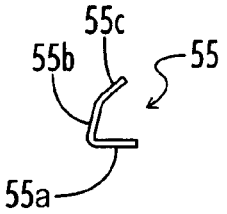

Turning then to the folding aid 50 illustrated in FIGS. 4*a*-4*c*, the aid 50 comprises a base surface 51 with four registers 52*a*, 52*b*, 52*c* and 52*d* located in the corner areas of the surface. It is possible to implement the invention with only two registers, typically proximate one edge of the surface 51, however, four registers facilitate the prompt location of a carton blank on the aid 50. Also on the surface 51 are four folding guides, namely the illustrated right guide 53, rear guide 54, left guide 55 and front guide 56. The four guides define an open rectangular base surface area within which a carton may be seated. Each guide, as shown in the sectional view of FIG. 4*c*, has a mounting segment 55*a*, a vertical segment 55*b* and an introductory segment 55*c*. The mounting segments 53*a*, 54*a*, 55*a*, 56*a* may have a variety of configurations, however, the depicted embodiment is designed for ease of bonding or welding the guide to the surface 51. It would be possible to mold the surface and guides as an integral piece, in which case no mounting segment would be necessary. The vertical segments 53*b*, 54*b*, 55*b*, 56*b* of the guides are preferably not precisely vertical but instead have an outward slant of approximately 5-20 degrees from the vertical. The introductory segments

53*c*, 54*c*, 55*c*, 56*c* are preferably angled outward at approximately 30-60 degrees from the vertical. As described below, the outward slant of the vertical and introductory segments assists in guiding the base of a carton blank toward the surface 51. In order for the carton blank to be properly positioned, the registers should be located outside the introductory segments of the folding guides.

Figure 5A:
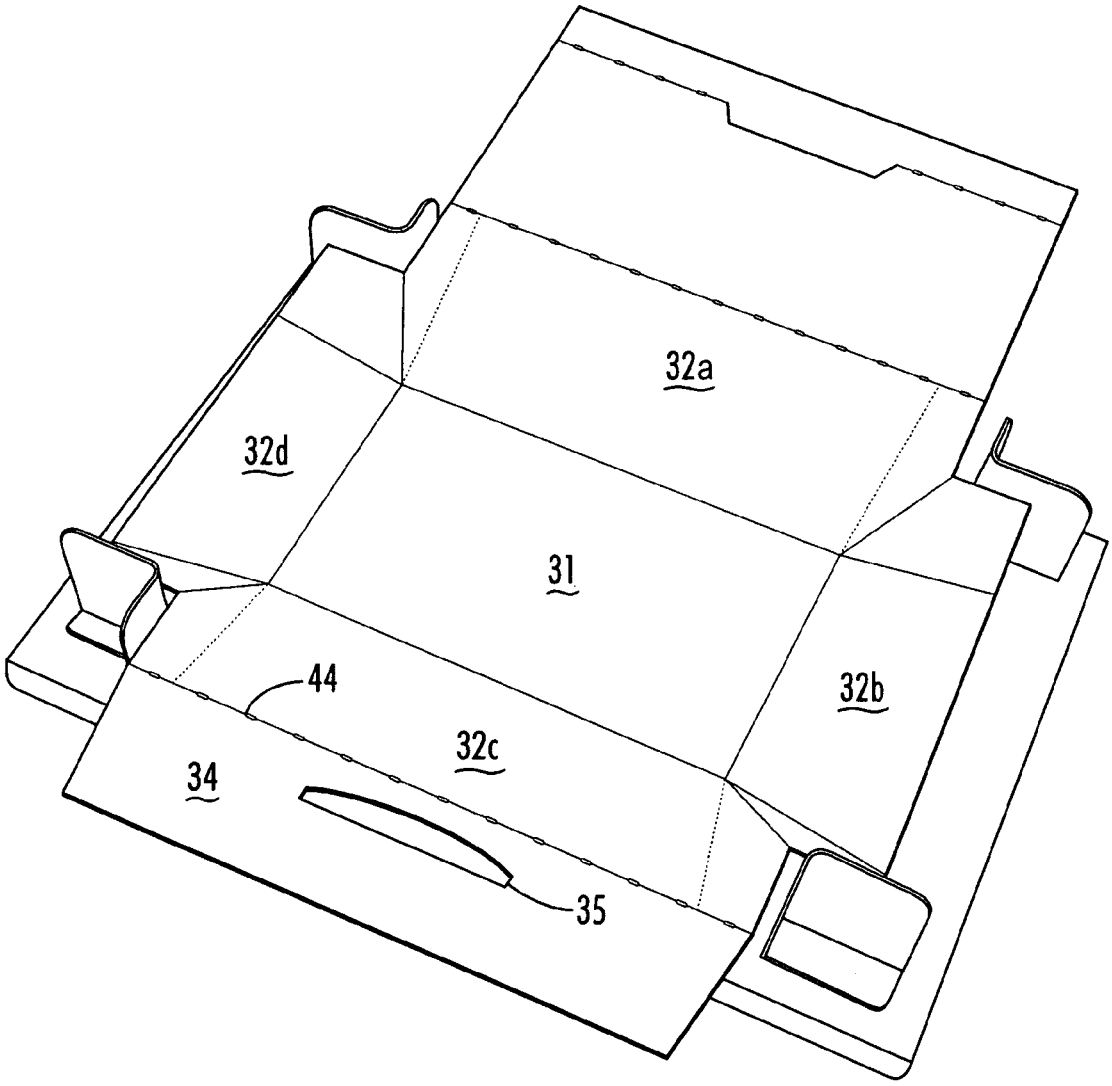
Figure 5D:
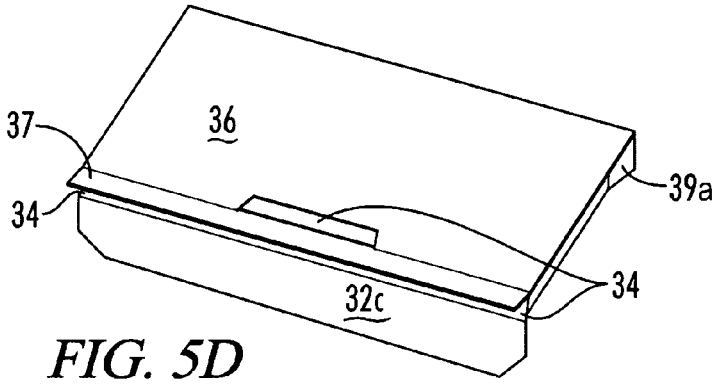
Figure 5B:
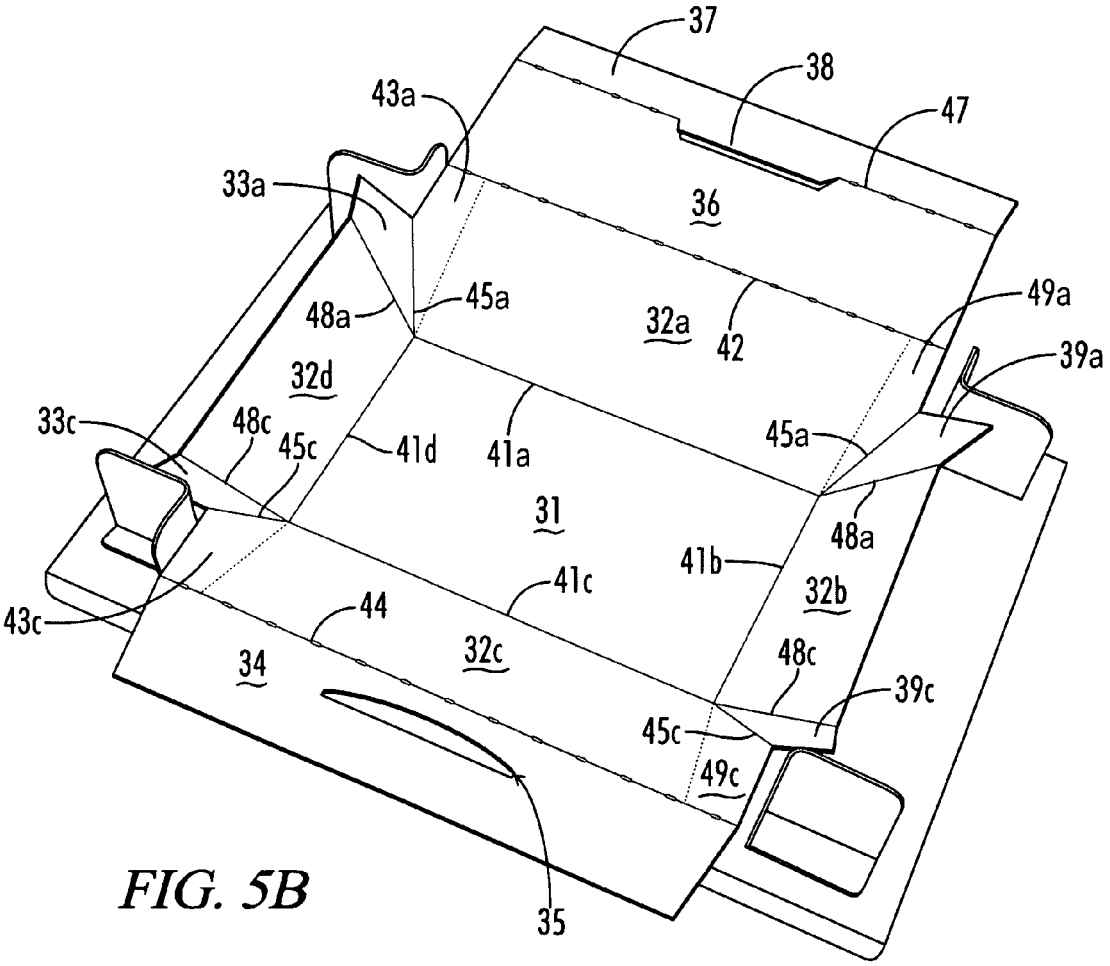
Figure 5C:
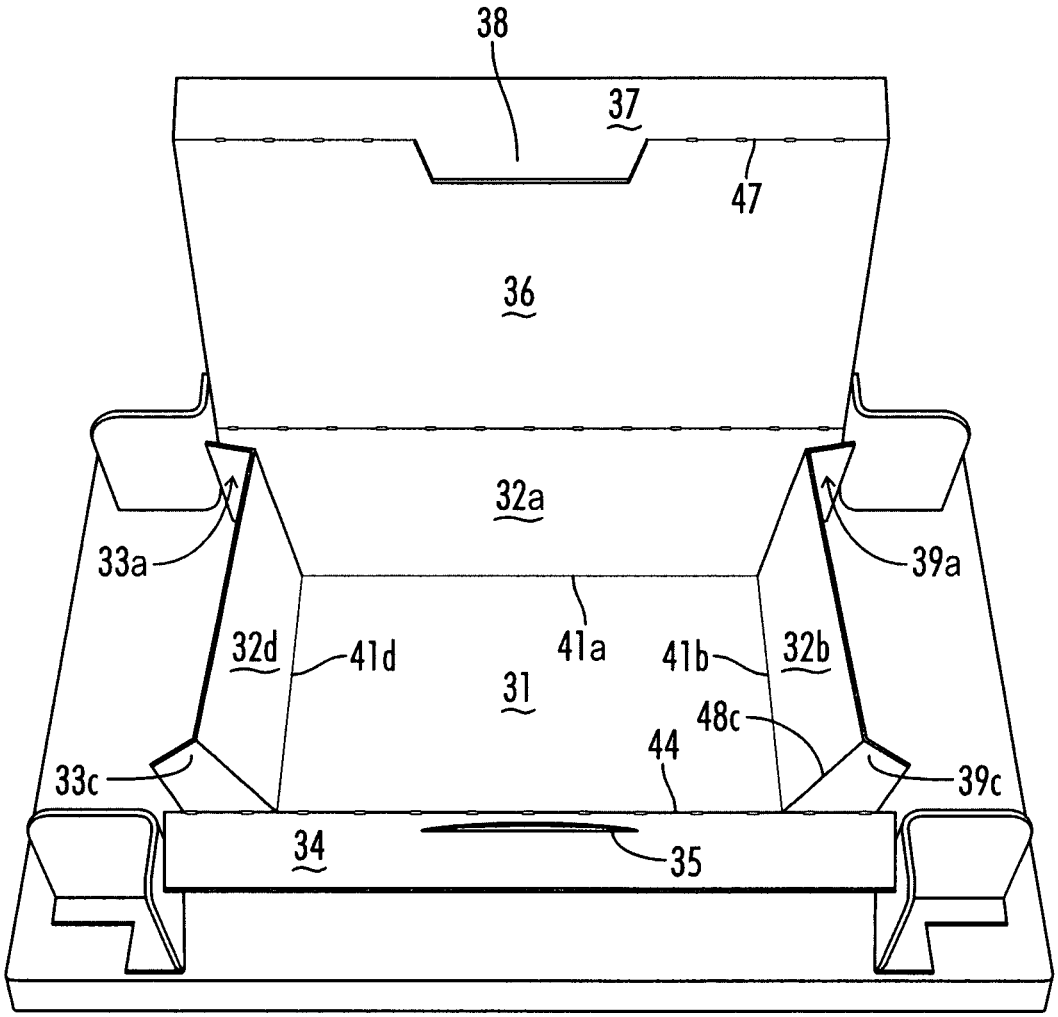

FIG. 5*a* depicts the placement of blank 30 on folding aid 50 with the four registers 52*a*-52*d* disposed in the alignment notches 61 of the blank to locate the blank 30 on the folding aid 50 in proper relationship to the folding guides 53-56. Typically, the distances between the folding guides will be approximately $1/10^{th}$ to 4/10ths of an inch greater than the corresponding width or length of the carton blank base 31. As illustrated in FIG. 5*a*, the carton wall panels 32*a*-32*d* are located intermediate the registers 52*a*-52*d*. In order to form a carton, downward pressure is placed on the base 31 and this pushed the base 31 toward the surface 51 while the folding guides hold the wall panels 32*a*-32*d* away from the surface. This causes the blank 30 to begin to fold along fold lines 41*a*-41*d* and the side panels 32*a*-32*b* begin to tilt upward from the planar base 31. In addition, the outward gusset folds of 45*a*, 45*c* each begin to fold outward while the inward gusset folds 48*a*, 48*c* begin to fold inward. FIG. 5*c* depicts the carton blank 30 when the base 31 has been pushed substantially into contact with surface 51 of folding aid 50. In this position, the side walls 32*a*-32*d* are erect and the corner gusset surfaces 33*a*, 43*a* and 33*c*, 43*c* on the left, as well as 39*a*, 49*a* and 39*c*, 49*c* on the right, are facing and contacting or nearly in contact with each other. The base and folded erect side walls create and define an interior carton space or volume for the placement of food products (and possibly ancillary items such as utensils). In order to secure the gusset surfaces against one another, the front lip flap 34 is folded rearward and the top 36 is folded downward with latch panel 38 tilted by pivoting flex lip 37 so that latch panel 38 can be inserted into front lip opening 35, resulting in the closed container configuration 30' shown in FIG. 5*d* with four outfold gussets. Numerous alternate latch configurations are possible, including placing openings on one or more of the side wall panels 32*b*-32*d* and having one or more lip flaps extending downward from the top 36 with a latch panel to engage a corresponding side wall panel opening.

The result is that by simply pushing the base 31 of carton blank 30 downward into contact with the folding aid surface 51 and folding the front lip flap 34 and top 36 with flex lip 37 and latch panel 38 the entire carton is constructed. Preferably the carton is filled while still sitting in the folding aid 50 and closed and latched and removed so the folding aid 50 may receive another carton blank 30. The latched carton 30' has an outfold gusset at each corner which provides a greater strength to weight ratio than is typically achieved in either ungusseted or folded gusset constructions. The gusset structure is shown in isolation in FIG. 6 where the outfold gusset panel 33*c* is folded outward from sidewall 32*d* and flush against the gusset landing area 43*c* of the front wall 32*c*.

Figure 6:
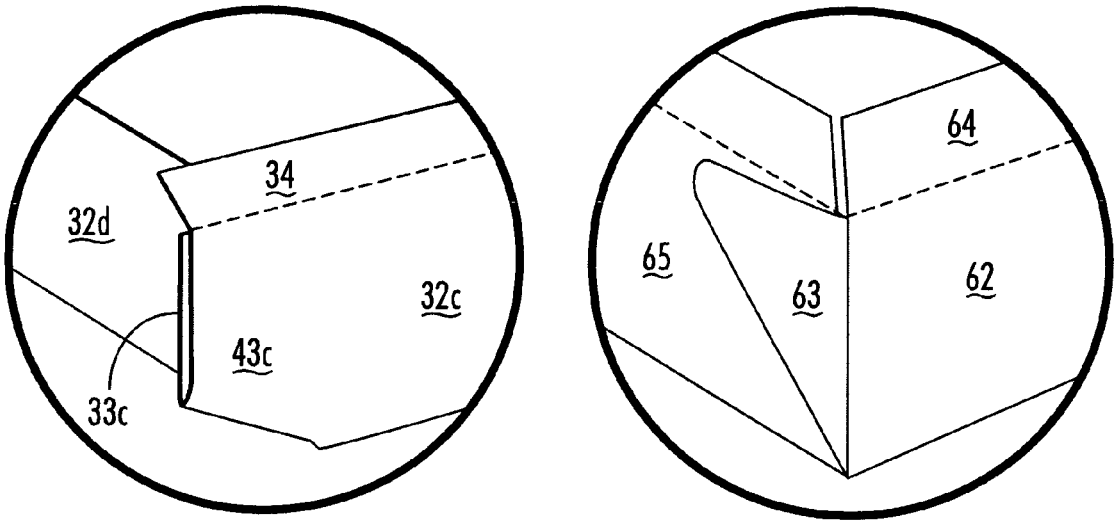
FIG. 6 is a perspective view of outward and folded gusset constructions in isolation.

The most similar carton designs are prefolded cartons with outfold gussets that are folded alongside the side walls of the carton and glued in place at extra expense, as shown with gusset 63 glued to sidewall 65 in FIG. 6. The unglued outfold gussets of the described embodiment, however, when combined with vertical side panels 32*a*, 32*b*, 32*c*, and 32*d* provide greater strength than folded or glued gussets of clamshell cartons and also allow more ready access to the interior of the carton when it is unlatched. As previously mentioned, prefolded and glued cartons are also more voluminous.

Figure 7:
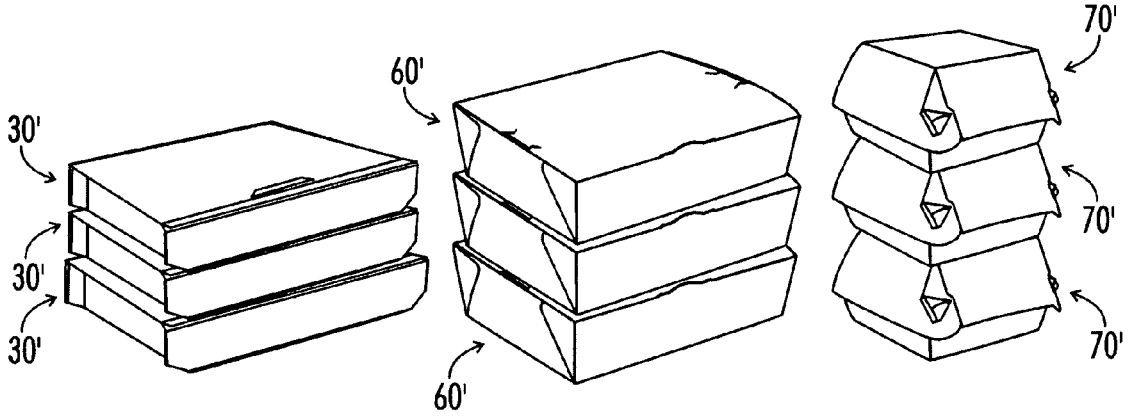
FIG. 7 is a perspective view of stacks of three different carton constructions.

The carton strength and stackability is illustrated in FIG. 7 with exemplary cartons formed according to aspects of the invention 30' are stacked adjacent to cartons 60' with folded and glued outfold gussets, and clamshell cartons 70'. It can be seen that the clamshell cartons 70' are less amenable to stacking and the sidewall and gusset structure of those clamshell cartons 70' provides less rigidity. Because it is necessary to be able to nest the empty clamshell cartons 70' during shipment (as shown in FIG. 9) and prior to use, the sidewalls of clamshell cartons must tilt slightly outward from the base, and do not provide vertical rigidity.

Figure 8:
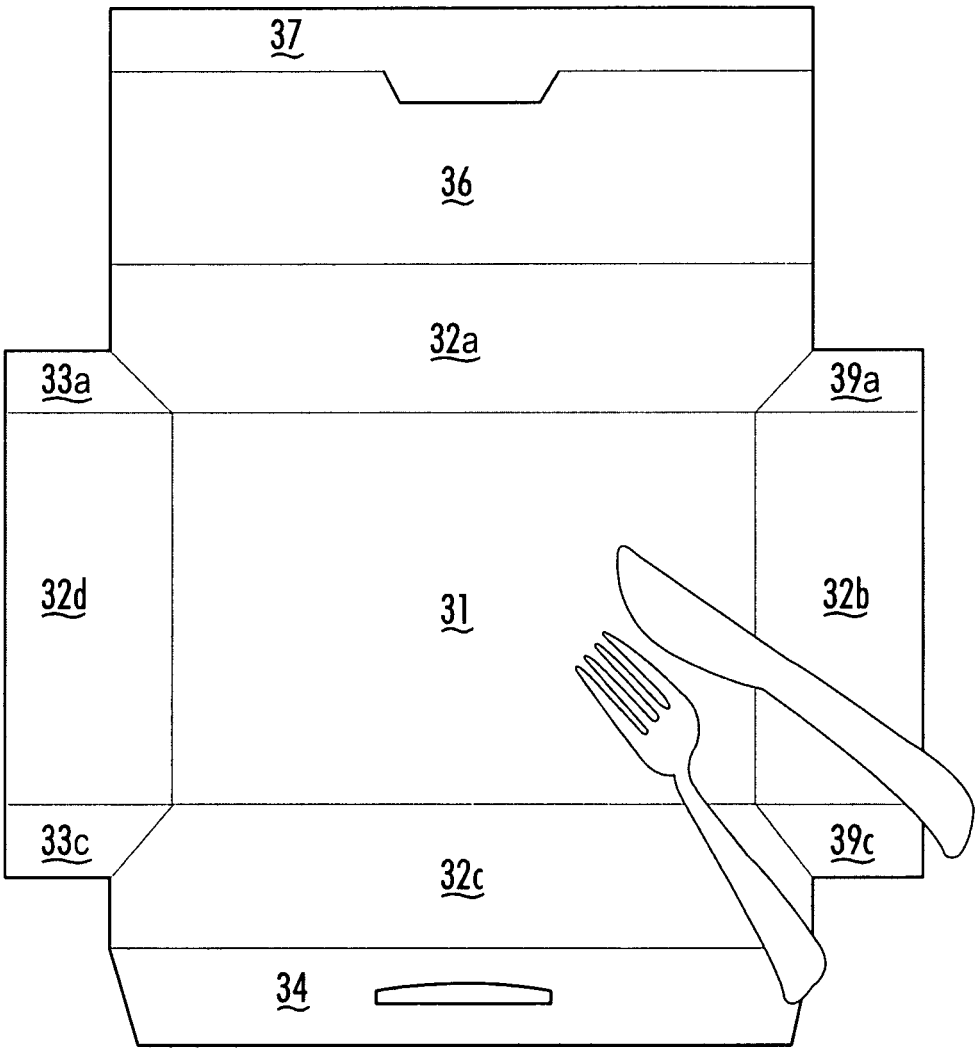
FIG. 8 is a top view of an exemplary carton after opening.

When the carton 30' is unlatched and opened the front wall panel 32*c* tends to release forward slightly as the carton blank 30 tends to slightly return toward its original flat shape. This slight flattening of the wall panels provides ready access to contents of the carton, as shown in FIG. 8. The efficiency with which strong, leak resistant cartons can be created utilizing the blanks, folding aid and method of the present invention is an improvement over prior art designs that do not include some preassembly of the carton. In addition, carton blanks according to the invention and folding aid dimensions may be adjusted to create a variety of carton sizes according to the needs of any particular food service establishment.

Figure 9:
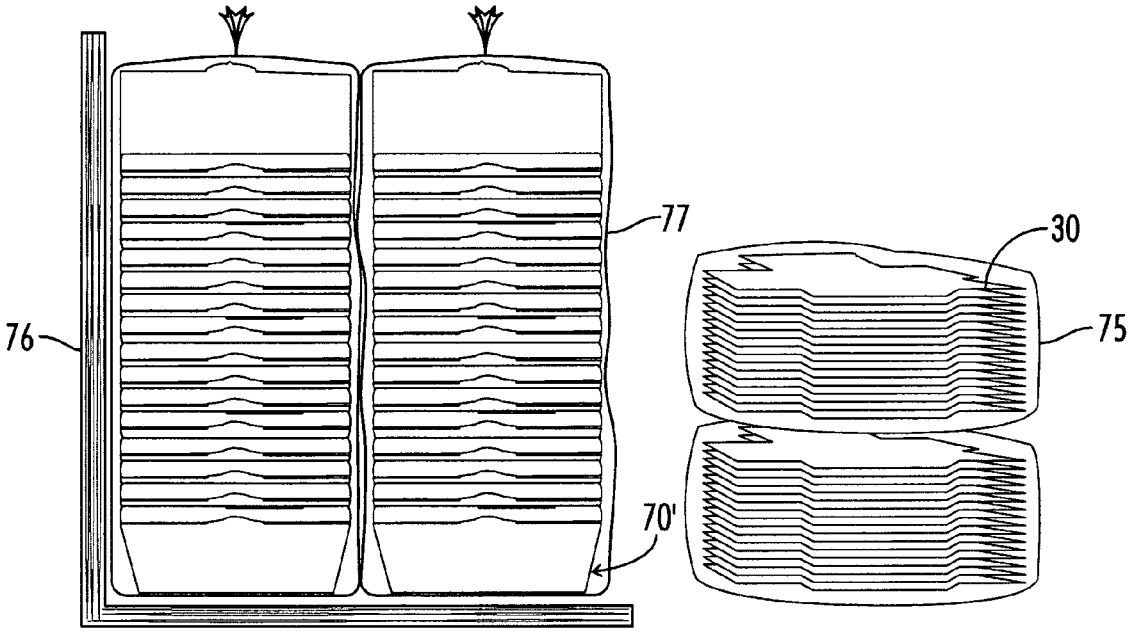
FIG. 9 is a contrasting perspective view of two-inch standard clamshell containers that are shipped nested in a corrugated box versus flat carton blanks of the type suitable for the present invention.

The economies in shipping and storage may be better appreciated with reference to FIG. 9 where clamshell cartons 70' are shown formed, glued, and stacked in nested arrangement in corrugated carton 76. In contrast the carton blanks 30 suitable for use in the present invention can be shipped completely flat, wrapped only in a flexible covering such as plastic wrap, and even palletized, with a space savings of over 30%, 40%, 50%, 60% and even 75% for smaller quantities (one to twelve dozen) relative to nested cartons. Plastic wrap 77 for clamshell cartons 70' is also greater than the wrap 75 for flat carton blanks 30. The result is that the carton blanks 30 require less transit space for shipping and less storage space after delivery. In addition to these savings, by avoiding the manufacturing steps of folding and gluing the blank, the carton blanks can be delivered to the retail food service establishment at lower cost.

All publications, patents and patent documents are incorporated by reference herein as though individually incorporated by reference. Although preferred embodiments of the present invention have been disclosed in detail herein, it will be understood that various substitutions and modifications may be made to the disclosed embodiment described herein without departing from the scope and spirit of the present invention as recited in the appended claims.

I claim:

1. A method for forming a base-type carton from a carton blank of the type having a rectangular base having a depth from front to back and a width from left to right, said base being circumscribed by rear wall fold line, right wall fold line, front wall fold line and left wall fold line; a rear wall panel connected along a lower edge to the base at the rear wall fold line and having a rear wall width relatively greater than the width of the base and connected along an upper edge to a top panel along an upper edge fold line; a right wall panel connected along a lower edge to the base at the right wall fold line; a front wall panel connected along a lower edge to the base at the front wall fold line; a left wall panel connected along a lower edge to the base at the left wall fold line; left and right rear outfold score lines extending outward respectively from left and right ends of the rear wall fold line; a first inward fold score line extending outward from the rear end of the right wall fold line defining a right side rear edge portion between said first inward fold score line and the right rear outfold score line; and a second inward fold score line extending outward from the rear end of the left wall fold line defining a left side rear edge portion between said second inward fold score line and the left rear outfold score line; so that the right side rear edge portion and left side rear edge portion extend outward beyond the rear wall width, whereby the junction of the rear wall panel and the right side rear edge portion and left side rear edge portion form rear alignment notches, by utilizing a folding aid of the type having a rectangular base surface with rear, right, front and left edges; a rear, right, front, and left folding guide mounted along each respective edge of the rectangular base surface wherein each folding guide has an upper introductory segment angled outward from the rectangular base surface and a lower more vertical segment; and a plurality of upstanding registers positioned outward of the introductory segments of the folding guides proximate a plurality of the corners of said base surface, comprising the steps of:

(a) positioning the alignment notches of the carton blank with the registers of the folding aid so that the rectangular base of the carton is positioned over the rectangular base surface of the folding aid;

(b) applying downward pressure on the rectangular base of the carton to bring it toward the rectangular base surface of the folding aid such that the folding guides cause:

(i) the rear, right, front and left wall panels to fold upward from the rectangular base of the carton along the rear, right, front and left wall fold lines creating an interior carton space; and (ii) the right side rear edge portion and left side rear edge portion fold to outward from the right and left side wall panels along the first and second inward fold score lines, and form outward gussets with the left and right edges of the rear wall panel;

(c) folding the top panel forward along the upper edge fold line of the rear wall over the rectangular base of the carton to the front wall.

2. The method for forming a base-type carton of claim 1 comprising the further step of placing food in the interior carton space before folding the top panel forward.

3. The method for forming a base-type carton of claim 1 comprising the further step of latching the top panel in place over the rectangular base of the carton.

4. The method for forming a base-type carton of claim 1 wherein the front wall panel of the carton blank has a front wall width relatively greater than the width of the base, and the carton blank further comprises left and right outfold score lines extending outward respectively from left and right ends of the front wall fold line, and a third inward fold score line extending outward from the front end of the right wall fold line defining a right side front edge portion between said third inward fold score line and the right front outfold score line, and a fourth inward fold score line extending outward from the front end of the left wall fold line defining a left side front edge portion between said fourth inward fold score line and the left front outfold score line so that the right side front edge portion and left side front edge portion extend outward beyond the front wall width, such the junction of the front wall panel and the right side front edge portion and left side front edge portion form front alignment notches, and applying downward pressure on the rectangular base of the carton in step (b) also causes:

(iii) the right side front edge portion and left side front edge portion to fold outward from the right and left side wall panels along the third and fourth inward fold score lines, and form outward gussets with the left and right edges of the front wall panel.

5. The method for forming a base-type carton of claim 1 wherein the front wall panel of the carton blank has an upper edge with a fold line and a lip flap panel connected along said upper fold line and prior to folding the top panel forward comprises the further step of folding the lip flap panel rearward, toward the interior of the carton.

6. The method for forming a base-type carton of claim 1 wherein the top panel of the carton blank has a tab that pivots along a fold line and the front wall panel has an upper edge with a fold line and a lip flap panel with an opening connected along said upper fold line, and prior to folding the top panel forward comprises the further step of folding the lip flap panel rearward, toward the interior of the carton, and after folding the top panel forward comprises the further step of pivoting the tab on the top panel to engage the opening of the lip flap panel and latch the carton.

7. The method for forming a base-type carton of claim 1 wherein the front wall panel has an upper edge with a fold line and a lip flap panel connected along said upper fold line, and prior to folding the top panel forward comprises the further steps of placing food in the interior carton space and folding the lip flap panel rearward, toward the interior of the carton.

* * * * *